US007734204B2

(12) United States Patent
Rowe

(10) Patent No.: US 7,734,204 B2
(45) Date of Patent: Jun. 8, 2010

(54) SYSTEM AND METHODS FOR REDUCING GHOSTING

(75) Inventor: Joseph H. Rowe, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 170 days.

(21) Appl. No.: 12/025,310

(22) Filed: Feb. 4, 2008

(65) Prior Publication Data

US 2009/0196656 A1 Aug. 6, 2009

(51) Int. Cl.
*G03G 15/02* (2006.01)

(52) U.S. Cl. ..... 399/50; 399/128; 399/170

(58) Field of Classification Search ..... 399/170, 399/171, 50, 128, 129; 250/324, 325, 326; 361/225

See application file for complete search history.

(56) References Cited

U.S. PATENT DOCUMENTS 4,437,755 A * 3/1984 Sakurayama et al. .... 399/170 X
4,477,179 A * 10/1984 Inuzuka et al. ..... 399/128
5,832,336 A * 11/1998 Kawasaki et al. ..... 399/50 X
6,832,058 B2 * 12/2004 Akita et al. ..... 399/129 X
2003/0147659 A1 * 8/2003 Yoshikawa et al. ..... 399/129 X

* cited by examiner

*Primary Examiner*—Sophia S Chen
(74) *Attorney, Agent, or Firm*—Pillsbury Winthrop Shaw Pittman LLP

(57) ABSTRACT

The presently disclosed embodiments are directed to imaging members useful in electrostatography. More particularly, the embodiments pertain to an improved development systems for electrophotographic imaging and printing apparatuses and machines in which ghosting print defects are reduced, and more particularly, is directed to a method for reducing positive ghosting in such systems.

19 Claims, 1 Drawing Sheet

SYSTEM AND METHODS FOR REDUCING GHOSTING

BACKGROUND

The present embodiments relate generally to development systems for electrophotographic imaging and printing apparatuses and machines in which ghosting print defects are reduced, and more particularly, is directed to a method for reducing positive ghosting in such systems.

Electrophotographic imaging members, e.g., photoreceptors, photoconductors, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

These photoreceptors have a target voltage which is the voltage that the photoreceptor surface becomes uniformly electrostatically charged. It is the optimum voltage for a xerographic system found through testing, and its determination depends on various systemic and environmental parameters. For example, the target voltage may be dependent on characteristics of the photoreceptor, such as the photoreceptor thickness, or characteristics of the development system, such as the type of toner and carrier. The target photoreceptor surface voltage also depends on the desired image quality, such as solid area density, line width, and avoidance of defects (such as background). The target P/R surface voltage is one of many variables that are optimized to achieve best overall performance.

Photoreceptors also have a maximum voltage, which is defined as the safe upper limit. Exceeding this value may cause damage to the photoreceptor due to dielectric breakdown and resulting holes that may form. The holes will cause spots in the reproduction prints. Likewise, the maximum photoreceptor surface voltage depends on the photoreceptor material and thickness. The target value is generally much lower then the maximum P/R surface voltage.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged at the target surface voltage. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer, an optional undercoat layer, and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

Conventional imaging members, however, have exhibited drawbacks when implementing image forming methods. One common problem is that in that electrons tend to remain in the charge generating layer after holes are first inject into the electrophotographic photosensitive member, and the electrons act as a kind of memory causing variations in potential. This problem, associated with charge accumulation, is known as "ghosting." Consequently, when a sequential image is printed, the accumulated charge results in image density changes in the current printed image that reveals the previously printed image. It is assumed that the electrons remaining in the charge generating layer advance for some reason to the boundary between the charge generating layer and the charge transporting layer, thereby reducing a barrier height for injecting holes in a vicinity of the boundary.

Ghosting can be described as developed image-forming patterns on a latent image-retaining member which are electrostatically transferred to a transfer material such as paper. These images become visual and the image formed can either be lighter than the background formed by toner deposition or darker than the background formed by toner deposition. In a situation where the ghost image is lighter than the background, the phenomenon is known as "negative ghosting." In a situation where the ghost image is darker than the background, the phenomenon is known as "positive ghosting."

Thus, as the demand for improved print quality in xerographic reproduction is increasing, there is a continued need for achieving improved performance, such as finding a way to minimize or eliminate charge accumulation in photoreceptors.

SUMMARY

According to aspects illustrated herein, there is provided a method for developing a latent image on an imaging surface, comprising charging an imaging surface, further comprising charging the imaging surface to a high voltage to accelerate removal of hole electron pairs, reducing surface voltage of the imaging surface to a low voltage to neutralize surface charge of the imaging surface, and charging the imaging surface to a target voltage to produce uniformity of the surface charge, exposing the imaging surface to an image to form an electrostatic latent image, forming a toner image with a toner-containing developer by developing the electrostatic latent image on the imaging surface, and transferring the toner image to a transfer substrate, wherein obtaining uniform surface charge on the imaging surface substantially reduces ghosting print defect.

Another embodiment provides a method for developing a latent image on an imaging surface, comprising charging an imaging surface, further comprising charging the imaging surface to about 1000 volts or more for a first portion of rotation to accelerate removal of hole electron pairs, reducing surface voltage of the imaging surface to from about 500 volts to about 550 volts for a second portion of rotation to neutralize surface charge of the imaging surface, and charging the imaging surface to about 600 volts for a third portion of rotation to produce uniformity of the surface charge, exposing the imaging surface to an image to form an electrostatic latent image, forming a toner image with a toner-containing developer by developing the electrostatic latent image on the imaging surface, and transferring the toner image to a transfer substrate, wherein obtaining uniform surface charge on the imaging surface substantially reduces ghosting print defect.

Yet another embodiment, there is provided a system for developing a latent image on an imaging surface, comprising a charging unit for charging an imaging surface, the charging unit comprising a first scorotron or first corotron for charging the imaging surface to a high voltage for a first portion of rotation to accelerate removal of hole electron pairs, a second scorotron or a second corotron for reducing surface voltage of the imaging surface to a low voltage for a second portion of rotation to neutralize surface charge of the imaging surface, and a third scorotron or third corotron for charging the imaging surface to a target voltage for a third portion of rotation to produce uniformity of the surface charge, an exposing unit for exposing the imaging surface to an image to form an electrostatic latent image, a toner-containing developer for forming a toner image by developing the electrostatic latent image on the imaging surface, and a transferring unit for transferring the toner image to a transfer substrate, wherein obtaining uniform surface charge on the imaging surface substantially reduces ghosting print defect.

BRIEF DESCRIPTION OF THE DRAWINGS

For a better understanding, reference may be made to the accompanying figures.

DETAILED DESCRIPTION

In the following description, reference is made to the accompanying drawings, which form a part hereof and which illustrate several embodiments. It is understood that other embodiments may be used and structural and operational changes may be made without departure from the scope of the present disclosure.

The present embodiments relate generally to development systems for electrophotographic imaging and printing apparatuses and machines in which ghosting is reduced, and more particularly, is directed to a method for reducing positive ghosting in such systems. Ghosting from non-uniform charging caused by hole electron pair traps in certain photoreceptors, e.g., amorphous silicon or "a-Si" photoreceptors, are reduced by using one or more charge scorotrons that cover 90 degrees of the drum surface. By charging the drum surface for a longer period of time than is generally necessary, traps are given more time to be eliminated. However, even with this design, ghosting still occurs enough to present a problem.

Figure 1:
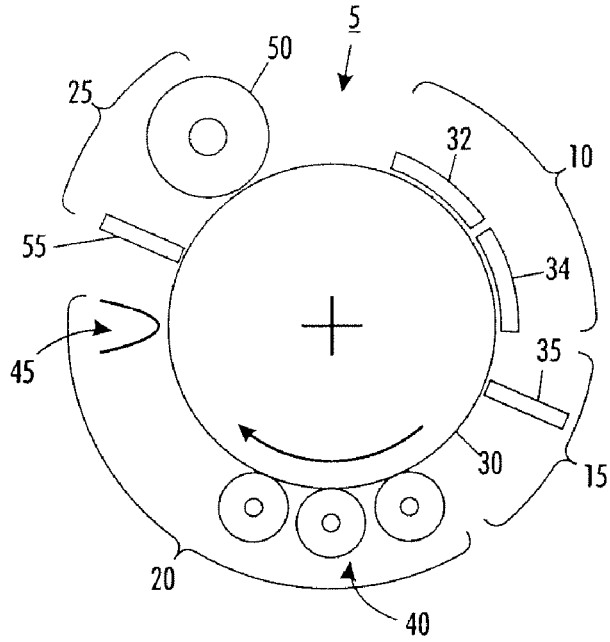
FIG. 1 PRIOR ART
FIG. 1 is a schematic nonstructural view showing a development system of a conventional printing machine.

For example, in inorganic photoreceptors such as amorphous silicon photoreceptors, positive ghosting is exhibited despite the use of one or more charge scorotrons. The print defect is primarily a positive ghost of a previous solid or text larger than 24 font showing up in half tones. Referring to FIG. 1, the conventional image forming method is shown in four stages along the development system 5 of a conventional printing machine. The first stage 10, provides charging of the photoreceptor surface. The second stage 15, provides exposure of the photoreceptor surface to an image to form an electrostatic image. The third stage 20, involves development and transfer of the formed image to a substrate such as paper. The fourth stage 25, provides an erasing procedure where the entire width of the photoreceptor surface is exposed to erase light to discharge the non-image areas down to near the image area such that a uniform charge on the surface is obtained prior to returning to the first stage 10.

In reference to the development system 5, the photoreceptor 30 is passed under a positive scorotron 32 in the first stage. Positive ions created by the 5000 volt positive scorotron are attracted to the neutral top surface of the photoreceptor 30. Electrons are drawn to the substrate below the a-Si coating due to the positive charge. An electric field across the a-Si material is created. A positive grid over the scorotron in combination with surface velocity, scorotron size, spacing and other like parameters result in a 600 volt positive charge on the surface. In the present embodiments, 600 volts is a target photoreceptor surface voltage. In the second stage, an exposing unit exposes the imaging surface to an image to form an electrostatic latent image. For example, an image is projected onto the charged surface via a light-emitting diode (LED) light bar 35. Photons enter the a-Si material and create hole electron pairs. The electrons under the influence of the electric field caused by the 600 volt charge, move to the surface and neutralize positive charge. The holes move to the substrate and free the electrons. The charge on the photoreceptor drum at the image location is reduced to 50 volts. In the third stage, the photoreceptor 30 passes into development 40 where toner is attracted to the low voltage image areas, e.g., via a toner-containing developer for forming a toner image by developing the electrostatic latent image on the imaging surface, and then onto transfer 45 via a transfer unit where the toner is transferred to a substrate, such as paper. Residual toner is removed via the cleaner 50 in the fourth stage. In the fourth stage, the entire width of the photoreceptor surface is exposed to erase light 55 to discharge the non-image areas down to near the image area because a uniform charge on the surface is desired prior to returning to the first stage.

There are three forms of photoreceptor ghosting that can result from the above stages in the development system 5. First, if the erase system is poor, the non-image 600 volt areas will not be discharged well. In the first stage 10, a marginal charging system will not be able to even out the difference between the image area and non-image area. The non-image area that comes into the charging system with a higher charge may leave with a higher charge. Scorotrons are useful in preventing such non-uniform charge. In the second stage 15, if the non-uniformity (previous cycle image) is in an area of half tones, the previous cycle image area with a lower surface charge will discharge the photoreceptor lower than the surrounding area. In the third stage 20, this lower voltage will result in more developed toner. The resulting image on paper will show positive ghosting.

A second form of photoreceptor ghosting results from light fatigue. In the second stage 15, hole electron pairs are trapped in the image area and do not migrate to the top surface and substrate. Thus, the surface is not discharged completely and the photoreceptor loses photosensitivity in this area. The defect may not be noticeable in the first pass. However, in the second cycle in the second stage 15, if this fatigued area falls into an area of half tones, the previous cycle image area will not discharge as well as the surrounding area and result in a higher charge. In the third stage 20, this higher voltage will result in less developed toner. The resulting image on paper will show negative ghosting.

The third form of photoreceptor ghosting is unique to a-Si photoreceptors. In the second stage 15, hole electron pairs are created but some move slowly to the top surface and substrate. The dark decay for a-Si is long. As a result, the photosensitivity of the entire surface is reduced, and more photons are required to achieve the desired discharge for a dark image. In the fourth stage 25, flooding the photoreceptor with photons does not eliminate these trapped hole electron pairs. In fact, the elimination of electric field only slows the migration of slow moving pairs even more. The result is the same as poor erase mentioned above, and there is a significant difference in surface voltage between the image area and non-image area after the erasing procedure. In the second cycle of the first stage 10, the previous cycle non-image area is charged higher then the previous image area. In the subsequent second stage 15, if the non-uniformity falls into a half tone area, the previous cycle non-image area will have a higher voltage and less toner development in the third stage 20 than the image area. The resulting image on the paper will show positive ghosting.

To overcome the above ghosting problems, the use of two charge scorotrons 32, 34 are incorporated into the conventional development system 5. The two charge scorotrons 32, 34 cover 90 degrees of the drum surface and have 32 grid wires each. The scorotrons 32, 34 are used to maintain a 600 volt surface potential as long as possible while hole electron pairs left over from the previous cycle reach the top surface and substrate. Unfortunately, at higher process or surface speeds, the charging time is insufficient to provide a surface charge uniform enough to prevent positive ghosting in half tones.

In the present embodiments, a method is provided to alleviate ghosting by charging the surface to very high voltages, e.g. about 1000V, for a first portion of rotation to provide more efficient migration of holes toward the surface (overvoltage), then discharge the photoreceptor using AC or negative corona for a second portion of rotation (undervoltage), and then charge the surface to the desired voltage using a scorotron for a third portion of rotation (target voltage).

Figure 2:
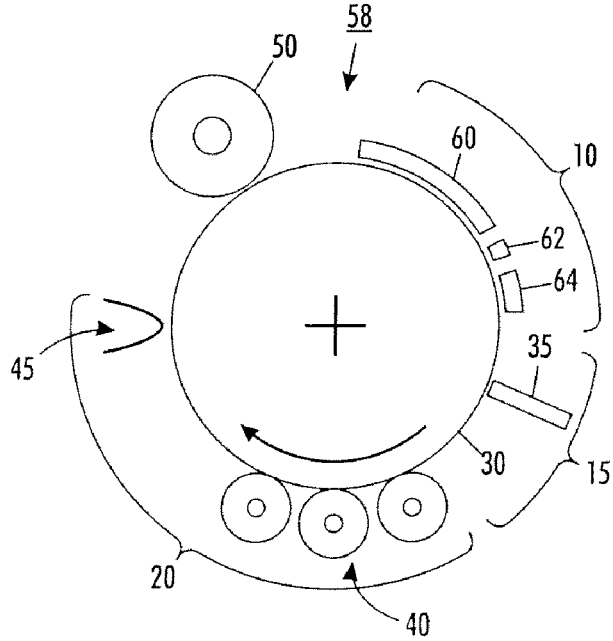
FIG. 2 is a schematic nonstructural view showing a development system of a printing machine according to the present embodiments.

Referring to FIG. 2, a schematic nonstructural view of a development system 58 according to one embodiment is shown. In the system 58, the conventional two scorotrons are replaced with three scorotrons or corotrons. In an embodiment, the conventional two scorotrons are replace with the following: a high voltage scorotron or corotron 60, an alternating current (AC) or negative continuous current (DC) corotron or scorotron 62, and a scorotron 64. The high voltage scorotron or corotron 60 is used to charge the surface to a high surface voltage for about 60 degrees of rotation to accelerate the removal of trapped hole electron pairs. For about 10 degrees of rotation, the AC or negative DC corotron or scorotron 62 is used to discharge the surface below the desired voltages, and then for about 20 degrees of rotation, the scorotron 64 is used to charge the surface to the desired voltage.

Thus, in the first stage 10 of the system 58, there is provided as a method for accelerating the elimination of hole electron pairs, thus improving surface charge uniformity and reducing ghosting. As the hole electron pair is a positive negative pair that will migrate in an electric field, the stronger the field, the faster the pair will migrate. If the electric field is increased to 1000 volts, the pairs should migrate as much as 67% faster than at 600 volts. In one embodiment, 1000 volts is the maximum photoreceptor surface voltage. In the first stage 10 of the development system 58, scorotron or corotron 60 covers 60 degrees or 120 mm of the drum surface and charges the surface to a maximum surface voltage, e.g., 1000 volts or more. This charging accelerates the removal of hole electron pairs. Next, corotron or scorotron 62, being a small AC or negative DC corotron or scorotron, reduces the surface voltage down to below 600 volts. In embodiments, the surface voltage is reduced down to just slightly below 600 volts, for one example, from about 500 to about 550 volts. Light erase is not used in the system 58, as it would generate more hole electron pairs. An AC or negative DC corona or scorotron will neutralize the surface charge without affecting the a-Si. Lastly, scorotron 64 charges the surface to the desired 600 volts or the target surface voltage. In specific embodiments, a 40 mm wide (20 degrees) positive DC volt scorotron is used for scorotron 64. Using a large scorotron for scorotron 64 is not necessary. Corona charging is very fast, and without hole electron pairs to neutralize the surface, the surface charge will be uniform going into the second stage in development system 58. As a result, positive ghosting will be more substantially reduced than in the conventional system 5. Depending on drum thickness and dielectric strength of the a-Si material, it may be possible to charge the drum higher than 1000 volts.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

What is claimed is:

1. A method for developing a latent image on an imaging surface, comprising:

charging an imaging surface, further comprising charging the imaging surface to a high voltage to accelerate removal of hole electron pairs, wherein the imaging surface is charged to the high voltage for a first portion of rotation, the first portion of rotation being about 60 degrees of rotation, reducing surface voltage of the imaging surface to a low voltage to neutralize surface charge of the imaging surface, and charging the imaging surface to a target voltage to produce uniformity of the surface charge;

exposing the imaging surface to an image to form an electrostatic latent image;

forming a toner image with a toner-containing developer by developing the electrostatic latent image on the imaging surface; and transferring the toner image to a transfer substrate, wherein obtaining uniform surface charge on the imaging surface substantially reduces ghosting print defect.

2. The method of claim 1, wherein charging the imaging surface to the high voltage for the first portion of rotation is performed by a first scorotron or a first corotron.

3. The method of claim 1, wherein the imaging surface is reduced to the low voltage for a second portion of rotation, the second portion of rotation being about 10 degrees of rotation.

4. The method of claim 3, wherein charging the imaging surface to the low voltage for the second portion of rotation is performed by a second scorotron or a second corotron.

5. The method of claim 4, wherein the second scorotron is selected from the group consisting of an AC scorotron and a negative DC scorotron, and the second corotron is selected from the group consisting of an AC corotron and a negative DC corotron.

6. The method of claim 1, wherein the imaging surface is charged to the target voltage for a third portion of rotation, the third portion of rotation being about 20 degrees of rotation.

7. The method of claim 6, wherein charging the imaging surface to the target voltage for the third portion of rotation is performed by a third scorotron or a third corotron.

8. The method of claim 1 further including cleaning residual toner from the imaging surface.

9. The method of claim 1, wherein the high voltage to accelerate removal of hole electron pairs is over 1000 volts.

10. The method of claim 1, wherein the low voltage to neutralize surface charge of the imaging surface is below 600 volts.

11. The method of claim 1, wherein the target voltage is about 600 volts.

12. The method of claim 1, wherein the ghosting print defect is positive ghosting.

13. The method of claim 1, wherein the imaging surface comprises amorphous silicon.

14. A method for developing a latent image on an imaging surface, comprising:

charging an imaging surface, further comprising charging the imaging surface to about 1000 volts or more for a first portion of rotation to accelerate removal of hole electron pairs, reducing surface voltage of the imaging surface to from about 500 volts to about 550 volts for a second portion of rotation to neutralize surface charge of the imaging surface, and charging the imaging surface to about 600 volts for a third portion of rotation to produce uniformity of the surface charge;

exposing the imaging surface to an image to form an electrostatic latent image;

forming a toner image with a toner-containing developer by developing the electrostatic latent image on the imaging surface; and transferring the toner image to a transfer substrate, wherein obtaining uniform surface charge on the imaging surface substantially reduces ghosting print defect.

15. A system for developing a latent image on an imaging surface, comprising:

a charging unit for charging an imaging surface, the charging unit comprising a first scorotron or first corotron for charging the imaging surface to a high voltage for a first portion of rotation to accelerate removal of hole electron pairs, a second scorotron or a second corotron for reducing surface voltage of the imaging surface to a low voltage for a second portion of rotation to neutralize surface charge of the imaging surface, and a third scorotron or third corotron for charging the imaging surface to a target voltage for a third portion of rotation to produce uniformity of the surface charge;

an exposing unit for exposing the imaging surface to an image to form an electrostatic latent image;

a toner-containing developer for forming a toner image by developing the electrostatic latent image on the imaging surface; and a transferring unit for transferring the toner image to a transfer substrate, wherein obtaining uniform surface charge on the imaging surface substantially reduces ghosting print defect.

16. The system of claim 15, wherein the high voltage to accelerate removal of hole electron pairs is over 1000 volts and the low voltage to neutralize surface charge of the imaging surface is below 600 volts.

17. The system of claim 15 further including a cleaner for cleaning residual toner from the imaging surface.

18. The system of claim 15, wherein the exposing unit comprises a LED light bar.

19. The system of claim 16, wherein the second scorotron is selected from the group consisting of an AC scorotron and a negative DC scorotron, and the second corotron is selected from the group consisting of an AC corotron and a negative DC corotron.

* * * * *